United States Patent [19]

Smith et al.

[11] 4,159,231

[45] Jun. 26, 1979

[54] METHOD OF PRODUCING A LEAD DIOXIDE COATED CATHODE

[75] Inventors: Lawrence L. Smith; Richard G. Sandberg, both of Rolla; Ernest R. Cole, Jr., Newburg, all of Mo.

[73] Assignee: The United States of America as represented by the Secretary of the Interior, Washington, D.C.

[21] Appl. No.: 931,068

[22] Filed: Aug. 4, 1978

[51] Int. Cl.[2] ..... C25B 1/30; C25C 7/00

[52] U.S. Cl. ..... 204/57; 204/290 F

[58] Field of Search ..... 204/57, 96

[56] References Cited

PUBLICATIONS

"Prelim. Studies on Superposition of A.C. on D.C. During Electrol. Prod. of $MnO_2$," by L. N. Dzhaparidze et al., Chem. Abstracts, v 76, 1972, No. 30087V.

*Primary Examiner*—R. L. Andrews

*Attorney, Agent, or Firm*—William S. Brown; Donald A. Gardiner

[57] ABSTRACT

A long-lived electrode is produced, for use in the electrowinning of metals, by electrodepositing a coating onto the electrode substrate. The coating has a uniform grain size and structure which is controlled by superimposing alternating current onto direct current during electrodeposition.

4 Claims, 2 Drawing Figures

METHOD OF PRODUCING A LEAD DIOXIDE COATED CATHODE

FIELD OF THE INVENTION

The present invention relates to an electrode used in the electrorefining of metals, and a method for its production.

BACKGROUND OF THE INVENTION

The electrowinning of metals is becoming increasingly important by providing for efficiency of metal recovery and concomitant energy conservation and reduced pollution. There has therefore been an increased interest in the development of a stable, inexpensive, inert anode for the electrowinning of metals from acid solutions. Such a development would provide for a substantial saving in time for the break-in of lead-lead dioxide anodes; reduce the amount of silver or antimony required for the alloying of conventional anodes; and decrease the amount of lead deposited on the cathode as an impurity during the subsequent use of lead containing anodes.

Lead dioxide deposited on a titanium substrate gives an anode that is relatively stable, but does not have the desired life. To increase the life of this anode, it was felt that it might be necessary to have a more dense and uniform coating as well as a substrate surface that was not passive.

The reversal of direct current has been used in an attempt to alter the crystal structure to eliminate dendrite growth and pit formation in zinc, copper, and nickel electrodeposition, in both electrowinning and electrorefining. For example, see Vene, Y. Y., and S. A. Nikolaeva. (Investigation of the Effect of Periodic Changes in Current Direction in the Electrodeposition of Copper From Sulfate Baths.) *Zhurnal Fizicheskoi Khimii,* v. 29, No. 5, 1955, pp. 811–817;

Volkov, L. V., and V. N. Andrushenko. (Use of Alternating Current for Improvement of Nickel Electroplating.) Tr. Proektn. NauchnoIssled. Inst. "Gipronikel," v. 62, 1975, pp. 99–104; abs. in Che. Abstracts, v. 84, 1976, No. 142479W.

However, the use of periodic reversal of direct current cannot give the wide possibilities of crystal structure control that is possible with superimposing alternating current onto direct current.

Superimposing alternating current onto direct current has been shown to keep metal substrates from becoming passive during electrolysis, as discussed in the following references:

Mantell, C. L. Industrial Electrochemistry. McGraw-Hill Book Company, Inc., New York, 3rd ed., 1950, p. 80;

Grube, G., and H. Gmelin. (The Influence of Superimposed Alternating Current on Anodic Ferrate Formation.) *Z. Elektrochem.,* v. 26, 1920, pp. 153–161; abs. in *Chem Abstracts,* v. 14, 1920, p. 2446;

Tucker, S. A., and H. G. Loesch. The Influence of Superimposed Alternating Current on the Electrodeposition of Nickel. *J. Ind. Eng. Chem.,* v. 9, No. 9, 1917, pp. 841–844;

Dzhaparidze, L. N., A. G. Shakarishvili, D. G. Otiashvili, V. P. Pruidze, and R. V. Chagunava. (Preliminary Studies on the Superposition of Alternating Current on Direct Current During Electrolytic Production of Maganese Dioxide.) *Pererab. Margantsevykh Polimental. Rud Gruz.,* 1970, pp. 138–143; abs. in *Chem. Abstracts,* v. 76, 1972, No. 30087V;

Skirstymonskaya, V. I. (Effect of Superimposed Alternating Current on the Electrodeposition of Zinc and Copper.) *J. Applied Chem.,* v. 10, 1937, pp. 617–622; abs. in *Chem. Abstracts,* v. 31, 1937, No. 6975;

Izgaruishev, N. A., and N. T. Kudryavtzev. (The Influence of Alternating Current on Current Efficiency in Electrolytic Precipitation of Metals.) *Z. Elektrochem.,* v. 38, 1932, pp. 131–135; abs. in *Chem. Abstracts,* v. 26, 1932, No. 2924;

Isgarishev, N., and S. Berkman. (The Effect of Alternating Current Upon Polarization in the Electrodeposition of Metals.) *Z. Elektrochem.,* v. 31, 1925, pp. 180–187; abs. in *Chem. Abstracts, v.* 19, 1925, No. 2168.

The patent literature also contains various types of current applications during electrodeposition. U.S. Pat. No. 2,443,599 involves a method for electroplating metal to a metal substrate using alternating current superimposed on direct current to produce a positive, pulsing voltage. U.S. Pat. No. 2,515,192 also superimposes alternating current on direct current to achieve uniform distribution. U.S. Pat. No. 2,706,170 uses alternating current superimposed on direct current for reducing internal stress. While it is evident that the method of superimposing alternating current onto direct current has been utilized for various purposes, it is clear that these applications do not produce a long-lived electrode since grain structure analysis was heretofore unknown.

Other related techniques are disclosed in U.S. Pat. Nos. 3,720,590 and 4,026,781.

SUMMARY OF THE INVENTION

In accordance with the invention, an electrode is produced having a significantly extended service life during electrowinning usage, by controlling various parameters during the deposition of lead dioxide onto a titanium electrode substrate utilizing alternating current superimposed on direct current to effect desired crystal (i.e., grain) structures of the deposited lead dioxide. The control parameters include: (1) the current density at the substrate electrode, (2) the temperature of the electrolyte solution during the electrodeposition process, (3) the direct current voltage, (4) the alternating current (peak-to-peak) voltage, and (5) the alternating current wave frequency.

These control parameters may be varied to achieve the desired density and homogeneity in crystal structure. For example, it has been discovered with grain size becomes finer with increasing alternating current voltage, and using sine wave application.

This control over the crystal structure of an electrolytic deposit by superimposing alternating current onto direct current has provided a lead dioxide-coated anode of increased life under the high-acid solution, high current density characteristics found in electrowinning processing.

Other features and advantages of the invention will be set forth in, or apparent from, the detailed description of the preferred embodiments found hereinbelow.

DESCRIPTION OF THE PREFERRED EMBODIMENTS

Figure 1:
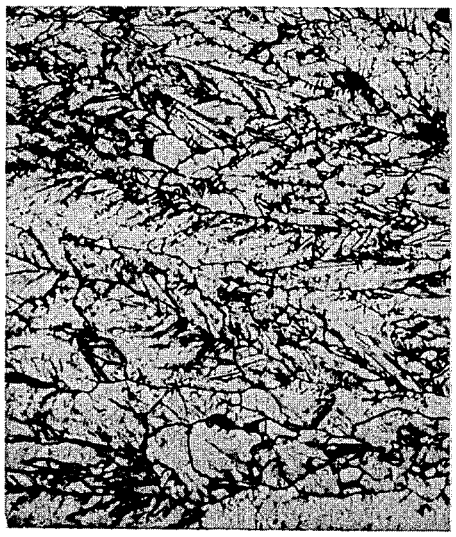
FIG. 1 is a magnified, photographic view of a cross section of the electrode microstructures found in the prior art.

The principal utility of the invention and general field of application is to control the crystal grain size and structure during the production of stable anodes to be used in electrometallurgy.

Electrometallurgy involves the use of an electric current to either bring about a purification of metal as in electrorefining, or reduce a metallic compound to metal as in electrowinning. In electrorefining, an impure metal anode, i.e., positive electrode, is placed in a solution of a salt of the metal being refined. The pure metal deposition occurs at the cathode, i.e., negative electrode, during electrolysis. In electrowinning, the impure metal ore is leached with an acid solution, which is then introduced into a cell containing insoluble anodes and cathodes. Metallic deposition also occurs at the cathode during electrolysis. Electrowinning usually requires large amounts of electrical power consumption due to the net free energy change for forming the solid metal from ionic form in the leaching solution.

The anodes used during the electrowinning process must therefore withstand the high acid leaching solutions as well as large voltages. Stable anodes include those having coatings such as lead dioxide, manganese dioxide, and other oxides, on metal substrates such as titanium.

In preparation of lead dioxide-coated titanium electrodes according to the invention for subsequent use as anodes for electrowinning, these electrodes are connected as anodes in the electrodeposition cell. The cathode may also be titanium but copper ions are added to inhibit deposition at the cathode so that lead dioxide deposition occurs only at the anode.

A practical application of the invention can be made by depositing lead dioxide onto a titanium sheet substrate having corrected edges and holes drilled in the sheet surface. The blank titanium sheets are sandblasted just prior to deposition of the lead dioxide.

The cleaned titanium sheets are then placed in an electrolyte solution which typically has a composition of:

| | | |
|---|---|---|
| Nitric acid, $HNO_3$ | 95–125 | grams/liter |
| Plumbous ions, $Pb^{+2}$ | 180–210 | grams/liter |
| Cuprous ions, $Cu^{+2}$ | 0.1 | grams/liter |
| Minus 325-mesh glass beads | 1–10 | grams/liter |

The electrolytic deposition occurs using alternating current superimposed on direct current, having optimal ranges for electroplating lead dioxide onto a titanium substrate of:

| | |
|---|---|
| Anode current density | 0.03–0.08 amps/cm$^2$ |
| Electrolyte temperature | 50°–80° C. |
| Direct current voltage | 1.4–5.0 volts |
| Alternating current voltage (peak-to-peak) | 1.6–7.2 volts |
| Wave frequency | 30–100 hertz |
| Wave form | sine, square, sawtooth, |

-continued

| | |
|---|---|
| | or ramp wave |

Crystal grain size of the lead dioxide deposit becomes finer with increasing alternating current voltage within the above range. The form and frequency of the alternating current wave will also alter the crystal structure, with sine waves producing the finest grain size.

The grain size, using the parameters within the above mentioned ranges, was found to be homogenous throughout the coating. In contrast, deposits made with the application of direct current only have a larger size near the titanium substrate, and an even larger grain size emanating away from the initial deposit adjacent to the titanium substrate.

Figure 2:
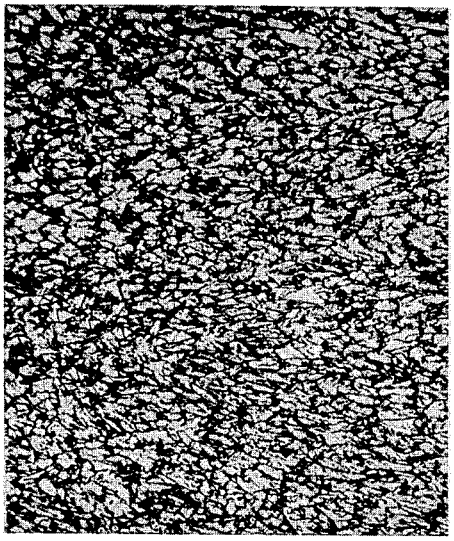
FIG. 2 is a magnified photographic view of a cross section of the electrode microstructure of the invention.

A comparison between the use of alternating current superimposed on direct current, with the application of direct current only is shown in the drawings. Both FIGS. 1 and 2 show the microstructure of cross sections of the lead dioxide coating of the anodes. FIG. 1 shows the large, uneven crystal structure when only direct current is used during electrodeposition. FIG. 2 shows the fine, homogenous structure that can be obtained when alternating current is superimposed on alternating current.

A specific example of the process of the invention involves an electrolyte composition containing:

| | |
|---|---|
| Nitric acid, $HNO_3$ | 100 grams/liter |
| Plumbous ions, $Pb^{+2}$ | 200 grams/liter |
| Cuprous nitrate, $Cu(NO_3)_2$ | 0.1 grams/liter |
| Minus 325-mesh glass beads | 5 grams/liter |
| with the control parameters set at: | |
| Anode current density | 0.06 amps/cm$^2$ |
| Direct current density | 3.1 volts |
| Alternating current density | 4.8 volts |
| Electrolyte temperture | 60° C. |
| Wave frequency | 60 hertz |
| Wave form | sine |

After four hours of deposition, the lead dioxide coated titanium sheet is removed from the electrolyte and tested in an electrolyte containing 200 grams/liter sulfuric acid for 80 days at 0.054 amps/cm$^2$ and 50° C., using an aluminum cathode. The life of these anodes is about 40 days longer than lead dioxide-coated anodes prepared using direct current only.

It is also contemplated that alternating current superimposed on direct current in accordance with the invention can be utilized for controlling the crystal structure and grain size during the electrowinning and electrorefining processing of other metals such as copper, zinc, chromium, cobalt, lead, and nickel. The invention could also aid in controlling dendrite growth and pit formation in cathode deposits.

Although the invention has been described relative to exemplary embodiments thereof, it will be understood that other variations and modifications can be effected in these embodiments without departing from the scope or spirit of the invention.

I claim:

1. A method for producing an electrode by the electrodeposition of a lead oxide coating upon a titanium electrode comprising immersing the titanium electrode and a cathode in an electrolyte solution containing nitric acid and lead ions in a concentration of about 180 to 210 grams per liter, establishing an electrical current by superimposing alternating current upon direct current to effect electrodeposition of said lead oxide wherein a uniform, dense grain size and structure of the electrodeposition coating is obtained by providing:

(1) an electrode current density of from 0.03 to 0.08 amps per centimeter squared, (2) an electrolyte temperature of from 50° to 80° centrigrade, (3) a direct current voltage of from 1.4 to 5.0 volts, (4) a peak-to-peak alternating current voltage of from 1.6 to 7.2 volts, (5) an alternating current wave frequency of from 30 to 100 hertz.

2. The method of claim 1 wherein the electrode current density is about 0.06 amps per centimeter squared, the direct current voltage is about 3.1 volts, the alternating current voltage is about 4.8 volts, the electrolyte temperature is about 60° C., and the wave frequency is about 60 hertz.

3. The method according to claim 1 wherein the electrolyte contains added metal ions which inhibit metal oxide deposition on the cathode.

4. An electrode comprising a titanium substrate and an electrodeposited lead oxide coating having a uniform, dense grain size and structure produced by the process of claim 1.

* * * * *